US006415758B1

(12) United States Patent
Pierro et al.

(10) Patent No.: US 6,415,758 B1
(45) Date of Patent: Jul. 9, 2002

(54) ENGINE BLOCK FOR AN INTERNAL COMBUSTION ENGINE

(75) Inventors: Enzo Pierro, Nr. Abingdon; John J. Purcell, Marlow; Hans-Jurg Nydegger, High Wycombe; Jean-Patrick Vernon Rich, London; Paul Farrall, Southend-on-Sea; Duane Busch, Beasonsfield, all of (GB)

(73) Assignees: Cummins Engine Company Ltd., Darlington; Iveco (UK) Ltd., Watford; New Holland U.K. Ltd., Basildon, all of (GB)

( * ) Notice: Subject to any disclaimer, the term of this patent is extended or adjusted under 35 U.S.C. 154(b) by 0 days.

(21) Appl. No.: 09/642,428

(22) Filed: Aug. 21, 2000

(30) Foreign Application Priority Data

Aug. 21, 1999 (GB) ..... 9919760

(51) Int. Cl.[7] ..... F02F 7/00
(52) U.S. Cl. ..... 123/195 R
(58) Field of Search ..... 123/195 R, 90.27, 123/90.31, 195 C, 195 H, 193.2, 195 A, 198 R, 198 C, 509

(56) References Cited

U.S. PATENT DOCUMENTS 4,121,557 A * 10/1978 Congram et al. ..... 123/195 R
4,125,036 A * 11/1978 Nakamura et al. ..... 123/90.27
4,607,601 A * 8/1986 Kohler ..... 123/90.31
4,885,953 A * 12/1989 Sweetland et al. .... 123/196 CP
5,669,346 A * 9/1997 Leweux et al. ..... 123/195 R

* cited by examiner

*Primary Examiner*—Marguerite McMahon
*Assistant Examiner*—Hyder Ali
(74) *Attorney, Agent, or Firm*—Gary M. Gron

(57) ABSTRACT

An engine block 10 is disclosed having machined front and rear faces. Each of the front and rear faces is capable of receiving and sealing against a housing (20,40) enclosing a gear train for coupling the engine crankshaft to a camshaft of the engine. The front face is additionally capable of directly receiving and sealing against an engine front cover while the rear face is additionally capable of directly receiving and sealing against a flywheel housing. In this way, the same engine block may be selectively assembled into an engine having a front mounted or a rear mounted camshaft gear train.

7 Claims, 3 Drawing Sheets

ENGINE BLOCK FOR AN INTERNAL COMBUSTION ENGINE

FIELD OF THE INVENTION

The present invention relates to an internal combustion engine and is particularly concerned with the design of the engine block of large capacity engines as used in trucks and agricultural vehicles.

BACKGROUND OF THE INVENTION

The gear train that drives the camshaft from the crankshaft in an internal combustion engine can be mounted either at the front end or the rear end of the engine. The rear of the engine refers to the end connected to the vehicle drive train, i.e. the end on which the flywheel and gearbox are mounted. From the point of view of reducing noise, the rear mounted drive train configuration is to be preferred but packaging considerations may dictate that the drive train be positioned at the front of the engine.

Heretofore, a manufacturer producing variants of the same engine having front and rear camshaft gear trains needed to produce two totally different engine blocks. This added to manufacturing costs.

SUMMARY OF THE INVENTION

The present invention provides an engine block having machined front and rear faces, wherein each of the front and rear faces is capable of receiving and sealing against a housing enclosing a gear train for coupling the engine crankshaft to a camshaft of the engine, and wherein the front face is additionally capable of directly mating with and sealing against an engine front cover and the rear face is additionally capable of directly mating with and sealing against a flywheel housing, whereby the same engine block may be selectively assembled into an engine having a front mounted or a rear mounted camshaft gear train.

As the size and shape of the drive train housing will usually differ from the size and shape of the engine front cover, or the flywheel housing, as the case may be, the front and rear faces of an engine block will have machined sealing surfaces and holes for receiving fastening elements that are redundant in any selected camshaft gear train configuration.

In the present invention, the same engine block can be sent to different assembly lines for the manufacture of engines having both front mounted and rear mounted gear trains. This results in a considerable cost saving, avoiding the need for separate castings for the different engine variants.

In order to be able to mount the gear or cog driving the camshaft at either end of the engine, it is important that there should be fastening elements provided at both ends of the engine to receive an axial thrust bearing plate to limit the axial displacement of the camshaft. It is possible to use these fastening elements at the front end of the engine to secure the front cover to the engine block when the camshaft gear train is mounted at the rear of the engine.

It is preferred to provide a water pump fastening element at the front end of the engine and to mount a belt driven water pump at the front end of the engine, regardless of the position of the camshaft gear train.

It is further preferred to provide fastening elements for mounting a gear driven oil pump at the front end of the engine to be driven from the front end of the engine crankshaft, regardless of the position of the camshaft gear train.

To facilitate the introduction of the camshaft into the engine block from either end of the engine and to enable the same camshaft to be used in both gear train configurations, it is preferred to provide bushed cam journals at both ends of the engine for supporting the camshaft.

It is also desirable to be able to reverse the oil pan and to this end it is advantageous to provide a symmetrical bolt pattern on the underside of the engine.

The camshaft gear train, in both engine configurations, may additionally include means for driving ancillary equipment, such as a mechanical fuel pump, a hydraulic pump or a power steering pump.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
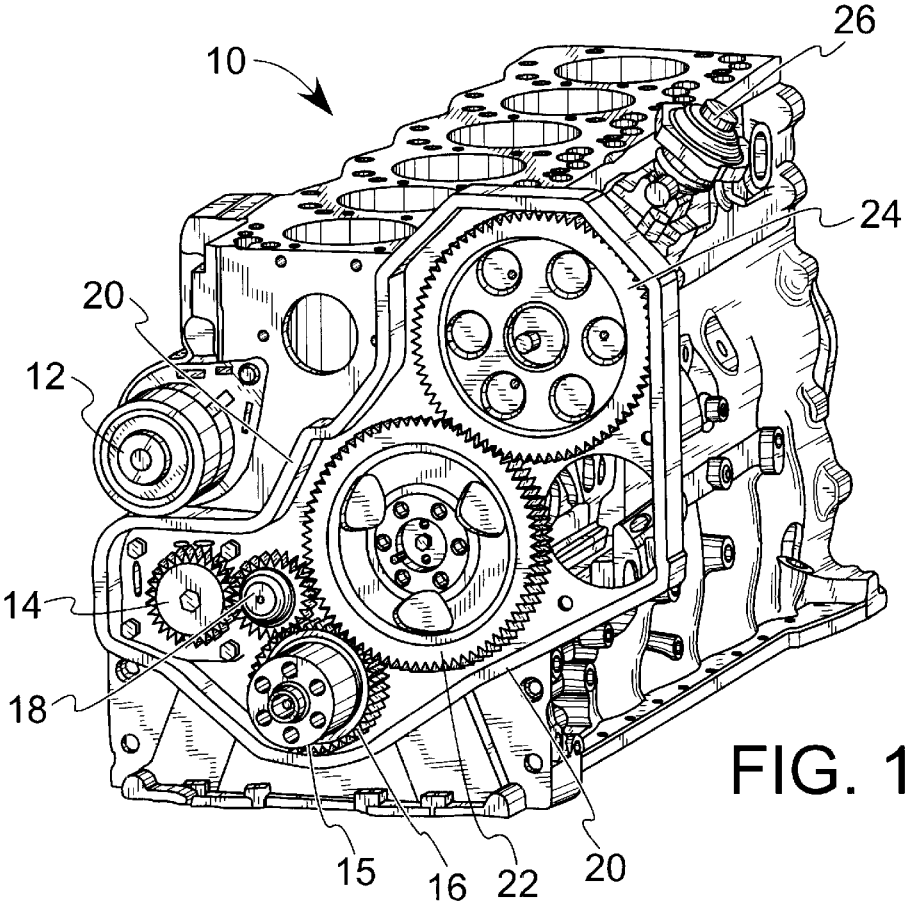
FIG. 1 is a front perspective view of an engine comprising a block of the engine and a front mounted camshaft gear train.

The drawings show two engines assembled using the same engine block 10. The engine of FIGS. 1 and 2 has a front mounted camshaft gear train housing 20 while the engine of FIGS. 3 and 4 has a rear mounted camshaft gear train 40.

The gear train housings 20 and 40 used in the two configurations are clearly not the same. When the camshaft gear train housing 20 is positioned at the front of the engine, it only needs to receive an access panel whereas the gear train housing 40 that fits at the rear of the engine must receive the flywheel housing and permit a flywheel to be mounted on the crankshaft 15.

The engine block 10 is nevertheless designed to optimise the number of components that can be used in both engine variants. Hence, in both engine variants, a water pump 12 is mounted on the front end of the engine to be driven by a belt from a pulley (not shown) mounted on the front end of the crankshaft 15. Furthermore, a gear driven oil pump 14 is mounted on the front end of the engine which in both engine variants is driven by a gear 16 fitted to the crankshaft 15 and acting on the oil pump drive gear through an idler gear 18.

The front face of the engine block 10 receives the housing 20 of the camshaft gear train in the manner shown in FIG. 1. The bolt pattern and sealing surfaces that enable the housing 20 to be mounted on the engine block 10 are better shown in FIG. 3. The front mounted camshaft gear train comprises a gear 22 directly meshing with the gear 16 on the crankshaft 15 and a further gear 24 that meshes with the gear 22 and drives ancillary equipment, such as a mechanical fuel injection pump 26.

Figure 2:
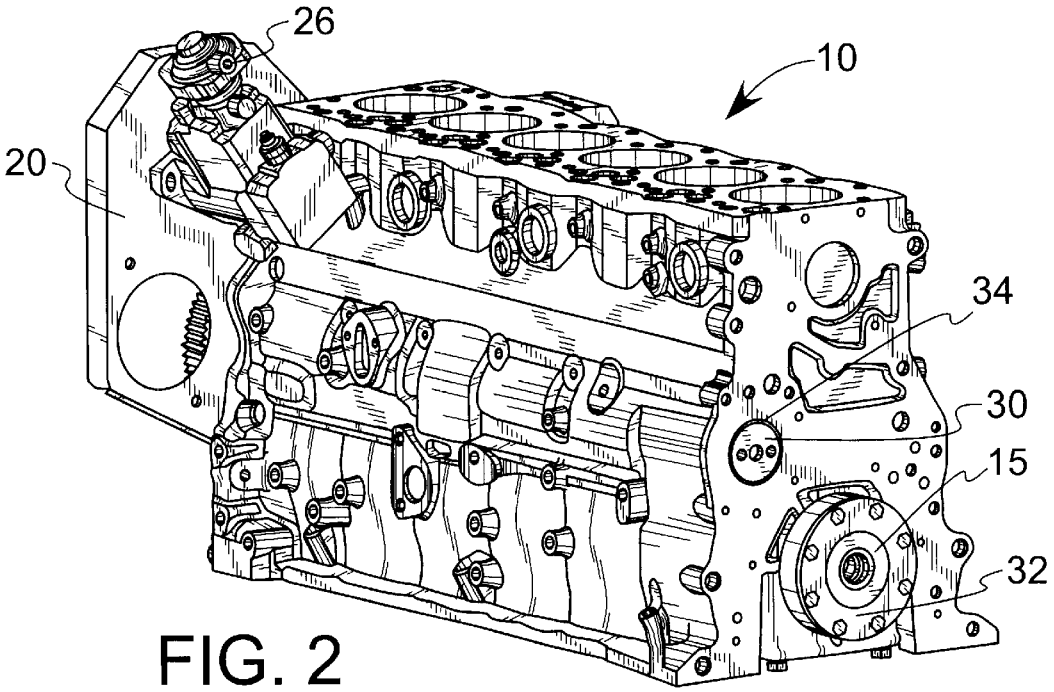
FIG. 2 is a rear perspective view of an engine comprising a block of the engine and a front mounted camshaft gear train.

As shown in FIG. 2, in which the camshaft gear train housing 20 is mounted at the front of the engine, the rear face of the engine has a machined surface and a bolt pattern to enable the flywheel housing to be directly bolted to the engine block 10. A collar 32 formed integrally with the crankshaft has bolt holes for mounting a flywheel next to the rear face of the engine.

Identical journal bearings 34 for the camshaft 30 are used at both ends of the block and there are bolt holes surrounding the camshaft journals at both ends of the block to mount a plate for resisting axial thrust on the camshaft.

Figure 3:
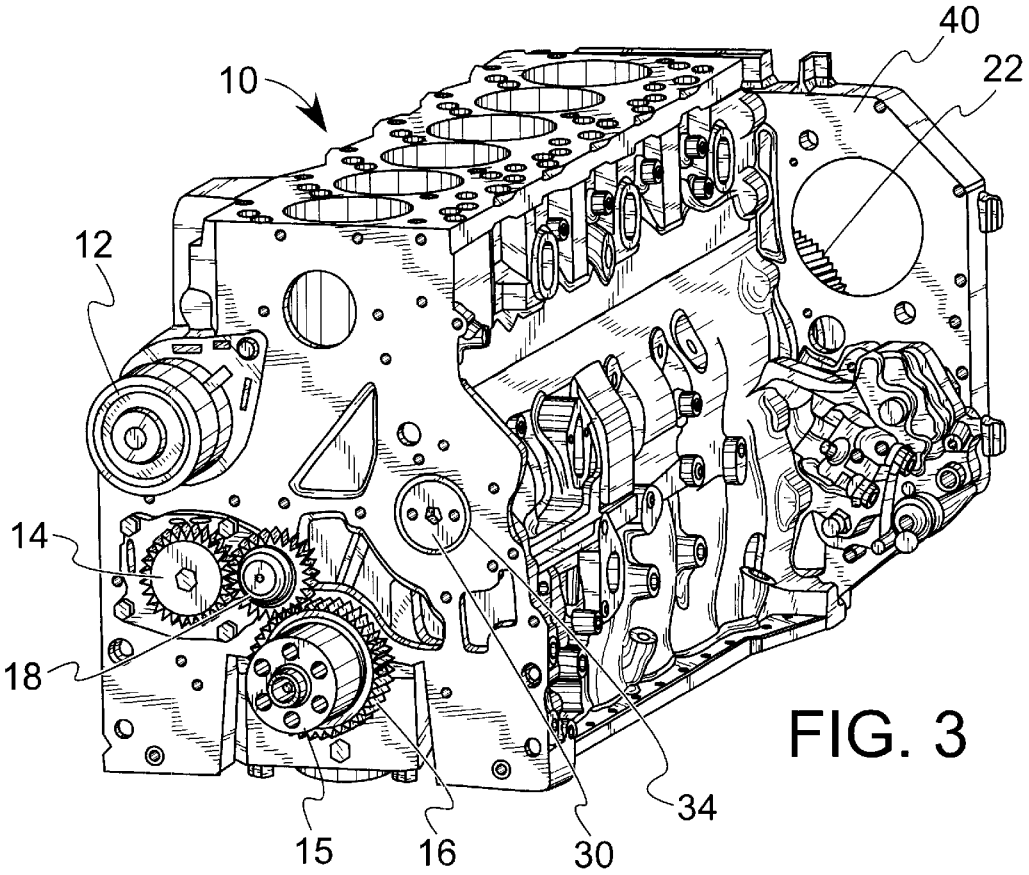
FIG. 3 is a front perspective view of an engine comprising a block of the engine and a rear mounted camshaft gear train.
Figure 4:
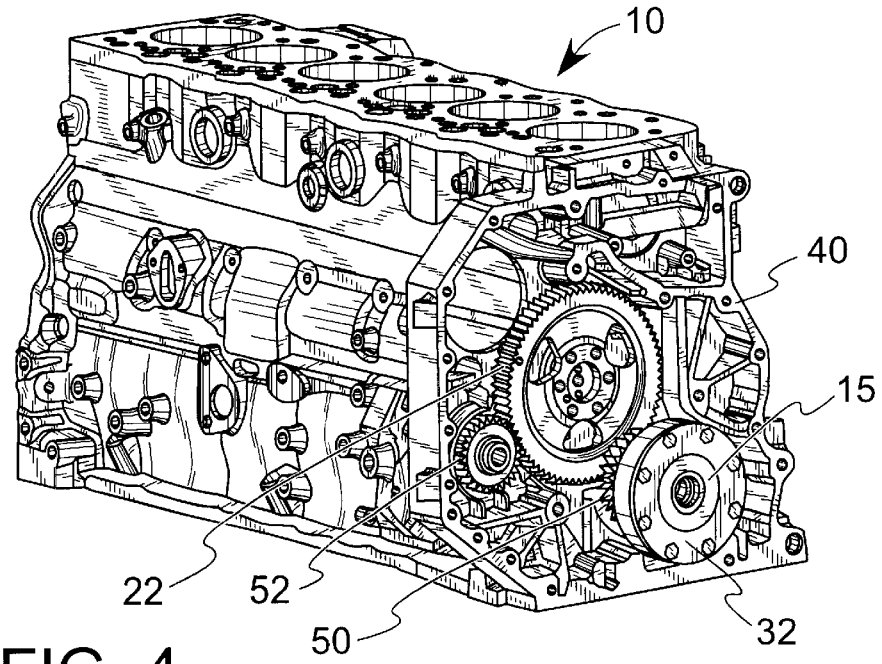
FIG. 4 is a rear perspective view of an engine comprising a block of the engine and a rear mounted camshaft gear train.

The sealing surfaces and the bolt hole pattern on the rear face of the engine also allow the camshaft gear train housing 40 be mounted on it in the manner shown in FIGS. 3 and 4. The rear mounted camshaft gear train housing 40 has aligned fastening holes to allow it to be mounted to the engine block 10 and other holes that allow the flywheel housing to be bolted through it to the engine block 10.

The rear mounted camshaft gear 22 can be the same as the one that fits the front end of the camshaft but in this case a gear 50 must be fitted on the crankshaft behind the collar 32. This can be achieved by heat shrinking the gear 50 and the collar 32 on the crankshaft. The gear 22 can also mesh with further gears, such as the gear 52, to drive ancillary equipment such as a hydraulic pressure pump or a power steering pump.

In the variant in which the drive train housing 40 is fitted to the rear of the engine, the front face (shown in FIG. 3) can receive a front cover that fits only over the gears 14, 16 and 18 and the front end of the camshaft 30. Such a cover will use some of the bolt holes provided for the front drive train housing 20 but as it is smaller than the housing 20, there will also be some sealing surfaces and bolt holds that are redundant.

As shown in FIGS. 5 to 8, different variants of the engine based on the engine block of the invention can all be designed to receive the same oil pan and the oil pan can be mounted with different orientations.

Figure 5:
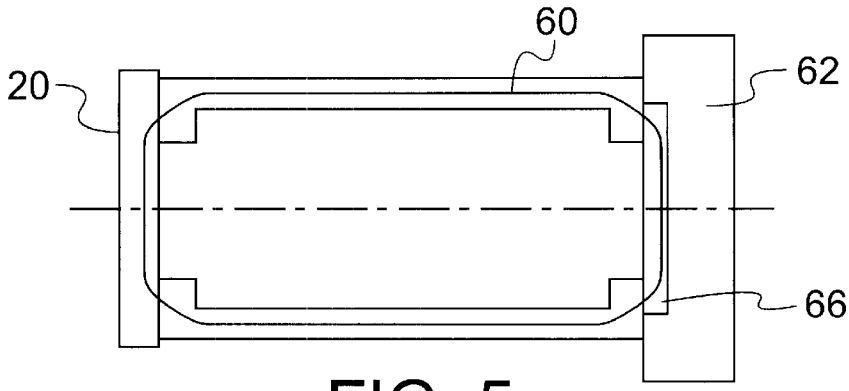
FIG. 5 is a view from below of an engine having a front mounted camshaft drive train housing.
Figure 6:
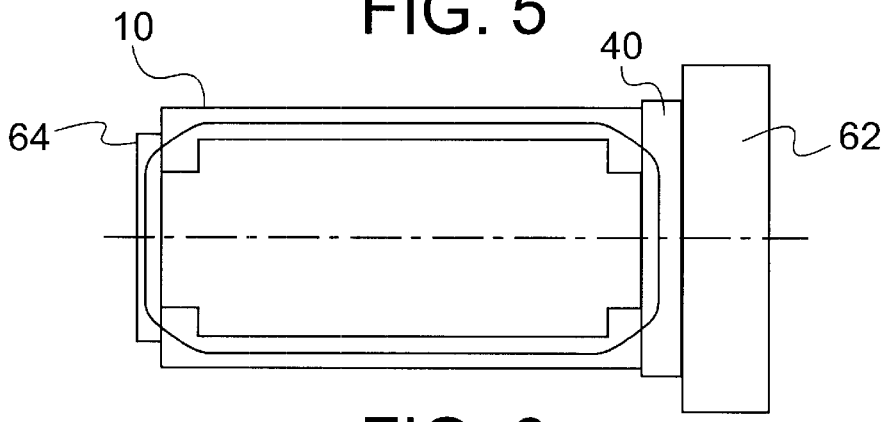
FIG. 6 is a view from below of an engine having a rear mounted camshaft drive train housing.

Thus in FIG. 5, the oil pan 60 overlaps the gear housing 20 at the front end of the engine and the flywheel housing 62 at the rear, whereas in FIG. 6 the same oil pan overlaps the engine front cover 64 at the front of the engine and the rear mounted gear housing 40 at the rear. To this end, the oil pan mounting holes in the front mounted gear housing 20 should match the bolt pattern in the engine front cover 64. Similarly, the bolt pattern in the rear mounted gear housing 40 should match that in a seal carrier 66 that is mounted beneath the flywheel housing 62 in the variant with a front mounted gear train housing 20.

Figure 7:
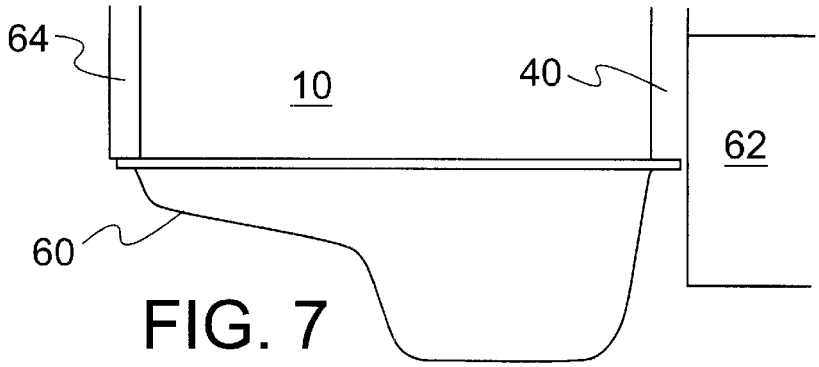
FIGS. 7 and 8 are sides views of two different engine variants having oil pans mounted on them in opposite ways.
Figure 8:
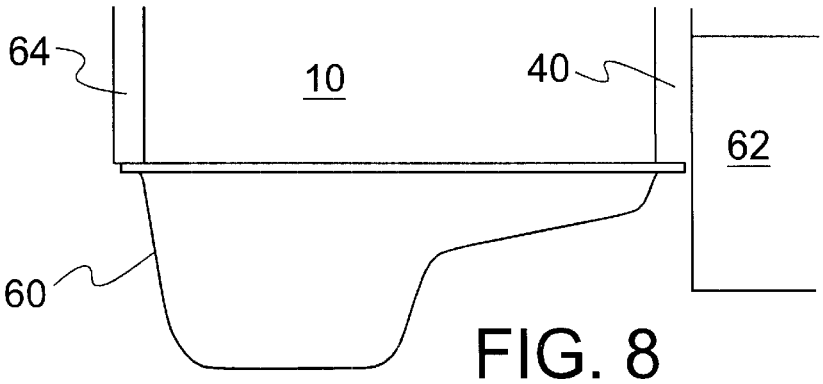

As shown in FIGS. 7 and 8, the oil pan 60 has a deeper section and a tray that slopes towards the deeper section. The bolt patterns on the underside of the engine and on the oil pan are symmetrical so that the deep section of the oil pan may either be located at the rear of the engine (as shown in FIG. 7) or at the front of the engine (as shown in FIG. 8).

Having thus described the invention, what is claimed as normal and desired to be secured by Letters Patent of the United States is:

1. An engine block having machined front and rear faces, wherein each of the front and rear faces is capable of receiving and sealing against a housing enclosing a gear train for coupling the engine crankshaft to a camshaft of the engines, and wherein the front face is additionally capable of directly mating with and sealing against an engine front cover and the rear face is additionally capable of directly mating with and sealing against a flywheel housing, whereby the same engine block may be selectively assembled into an engine having one of a front mounted and a rear mounted camshaft gear train, wherein each cover and housing has a plurality of holes in predetermined positions, machined sealing surfaces on the front and rear faces have a plurality of holes in predetermined positions, there being sufficient numbers of holes on the front and rear faces of the block to align with all the holes of the covers and housings, said block further comprising fastening elements received in said holes, whereby there are redundant holes in any selected camshaft gear train configuration.

2. An engine block as claimed in claim 1, further comprising fastening elements provided at both ends of the engine to receive an axial thrust bearing plate to limit the axial displacement of the camshaft.

3. An engine block as claimed in claim 2, wherein the fastening elements at the front face of the engine for receiving an axial thrust bearing plate are suitable to receiving a front cover overlying the end of the camshaft and the front end of the crankshaft.

4. An engine block as claimed in claim 1, comprising a water pump fastening element only at the front end of the engine.

5. An engine block as claimed in claim 1, further comprising fastening elements for mounting a gear driven oil pump only at the front end of the engine to be driven from the front end of the engine crankshaft.

6. An engine block as claimed in claim 1, further comprising bushed cam journals provided at both ends of the engine for supporting the camshaft.

7. An engine block as claimed in claim 1, a symmetrical bolt pattern on an open lower surface, said block further comprising an oil pan mounted on the underside of the engine.

* * * * *